US006986706B1

(12) United States Patent
Cooper et al.

(10) Patent No.: US 6,986,706 B1
(45) Date of Patent: Jan. 17, 2006

(54) POLISHING PAD AND METHOD OF PRODUCING THE SAME

(75) Inventors: Alex Cooper, Brooklyn, NY (US); Yevgeny Bederak, Long Meadow, MA (US)

(73) Assignee: Universal Photonics, Inc., Hicksville, NY (US)

( * ) Notice: Subject to any disclaimer, the term of this patent is extended or adjusted under 35 U.S.C. 154(b) by 0 days.

(21) Appl. No.: 10/916,379

(22) Filed: Aug. 10, 2004

(51) Int. Cl.
*B24D 11/00* (2006.01)

(52) U.S. Cl. ..... 451/527; 451/921; 451/530; 451/533; 451/537; 451/539; 451/550

(58) Field of Classification Search ..... 451/527, 451/921, 530, 533, 537, 539, 538, 534, 550
See application file for complete search history.

(56) References Cited

U.S. PATENT DOCUMENTS 3,991,527 A * 11/1976 Maran ..... 451/529
5,201,785 A * 4/1993 Nagano ..... 451/508
5,769,699 A * 6/1998 Yu ..... 451/528
5,775,984 A * 7/1998 Olson et al. ..... 451/536
5,899,745 A * 5/1999 Kim et al. ..... 438/692
6,454,644 B1 * 9/2002 Miyazaki et al. ..... 451/526
6,604,990 B2 * 8/2003 Cooper et al. ..... 451/526

* cited by examiner

*Primary Examiner*—George Nguyen
(74) *Attorney, Agent, or Firm*—I. Zborovsky

(57) ABSTRACT

A polishing pad has a working layer provided with an abrasive powder, an attaching layer for attaching a pad to a polishing head of a power tool, and a connection layer which connects the working layer with the attaching layer, the connection layer being located between the working and the attaching layer and having a peripheral region which is thinner and also a central region which is thicker than the peripheral region and therefore has an increased elasticity so that during polishing an elasticity of a central portion of the working layer is increased.

7 Claims, 1 Drawing Sheet

POLISHING PAD AND METHOD OF PRODUCING THE SAME

BACKGROUND OF THE INVENTION

The present invention relates to a polishing pad and to a method of producing the same.

Polishing pads and methods of producing the same are well known and disclosed in U.S. Pat. Nos. 4,969,914; 4,709,513; and 6,604,990. It is believed that the existing pads and the method of making the same can be further improved.

SUMMARY OF THE INVENTION

Accordingly, it is an object of the present invention to provide a polishing pad and a method of making the same, which constitute further improvements of the existing polishing pads and methods of producing the same.

In keeping with these objects and with others which will become apparent hereinafter, one feature of the present invention resides, briefly stated, in a polishing pad which has a working layer provided with an abrasive powder; an attaching layer for attaching a pad to a polishing head of a power tool; and a connection layer which connects said working layer with said attaching layer, said connection layer being located between said working layer and said attaching layer and having a peripheral region which is thinner and also a central region which is thicker than said peripheral region and therefore has an increased elasticity so that during polishing an elasticity of a central portion of said working layer is increased.

In accordance with another feature of the present invention, a method for producing a polishing pad is proposed, which includes the steps of applying a pressing tool so as to compress the peripheral region of said adhesive layer more and to compress the central region of said connection layer less during a connection of the working layer with said attaching layer.

When the polishing pad is designed and the method is performed in accordance with the present invention, then the connection layer has a greater elasticity in its central region, and as a result during polishing with the inventive polishing pad a more elastic action is provided in the central region of the working layer and the polishing pad, which is beneficial for the polishing process.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
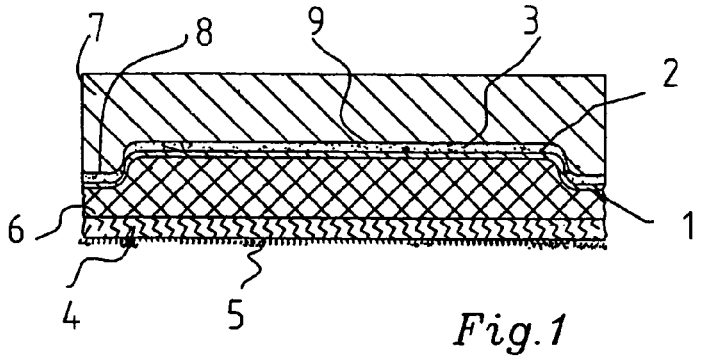
FIG. 1 is a view showing a cross-section of a polishing pad in accordance with the present invention and illustrating a method of its manufacture.

A polishing pad has a working layer which includes a body 1, and a polishing powder having a plurality of abrasive grain such as for example grains of $CeO_2$, $Al_2O_3$ or other materials, embedded in a binder 2 and attached to the body 1.

The polishing pad further has an attaching layer composed of an attaching layer 4 provided with a plurality of loops or hooks 5 for interengaging connection with hooks or loops of a polishing head of a power tool.

The working layer 1 and the attaching layer 4 are connected with one another by a connection layer 6. The connection layer 6 can be composed of a volcanizable material, for example of nitrylbytadiene rubber.

In order to produce the polishing pad, a suspension of the binder 3 of the working layer is applied on the body 1, and the abrasive powder 2 is placed on the surface of the suspension, then the intermediate connection layer 6 is provided, and the attaching layer 4 is placed to the lower surface of the connection layer 6. The thusly formed multilayer structure is subjected to a temperature of for example of 140–160° C. and pressure of 0.4–0.6 MPa for 3–5 minutes. As a result the grains of the abrasive powder 2 are wetted with the binder 3 and form a substantially rigid layer on the body 1, with which they are connected. At the same time the vulcanizable layer 6 is vulcanized and reliably non-releasably connects the working layer with the attaching layer.

During the manufacture of the bed pad, in accordance with the present invention a pressure is applied by a top plate 7, for example by a steel plate. The steel plate can be formed so that it has a downwardly projecting peripheral region 8 and a central cavity 9. As a result, during the process of pressing, the peripheral region of the connecting layer 6 is compressed more while the central region of the connection region 6 is compressed to less, so that the peripheral region of the connection layer 6 becomes thinner and the central region of the connection layer 6 becomes thicker and more elastic. The working layer, 1, 2, 3 of the thusly produced pad can therefore yield elastically in its central portion connected by the thicker central region of the connection layer 6 to the attaching layer 4, than its peripheral region connecting by the peripheral region of the connection layer 6 to be attaching layer 4.

The thinner peripheral region at the connection layer 6 is ring-shaped, while its thicker inner region is disc-shaped.

During the polishing process, the central region of the working layer 1, 2, 3, which is connected to the attaching layer 4 by a thicker, more elastic central region of the connection layer 6, has higher elastic properties, which improves the polishing process.

Figure 2:
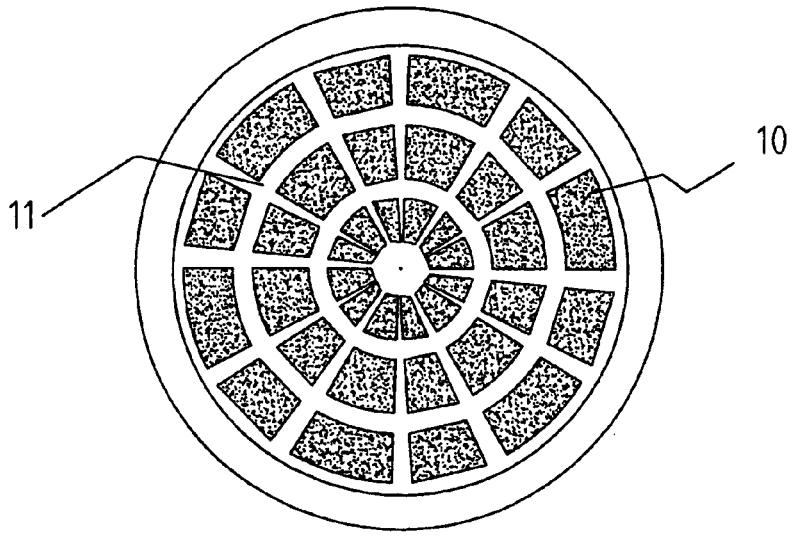
FIG. 2 is a plan view of the inventive polishing pad in accordance with another embodiment of the present invention.

In the embodiment shown in FIG. 1, the working layer 1, 2, 3, is formed as an uninterrupted disc-shaped layer. However, the working layer can be also different, in particular it can be formed as an interrupted layer. One of such interrupted layers is shown in FIG. 2. Here the working layer is composed of a plurality of individual elements 10 each including the body 1, with the abrasive powder 2 in the binder 3. The individual elements 10 are spaced from one another for example in two mutually perpendicular directions, so as to provide gaps 11 therebetween. The gaps improve supply of a cooling fluid and withdrawal of a material removed from a workpiece during polishing.

Figure 3:
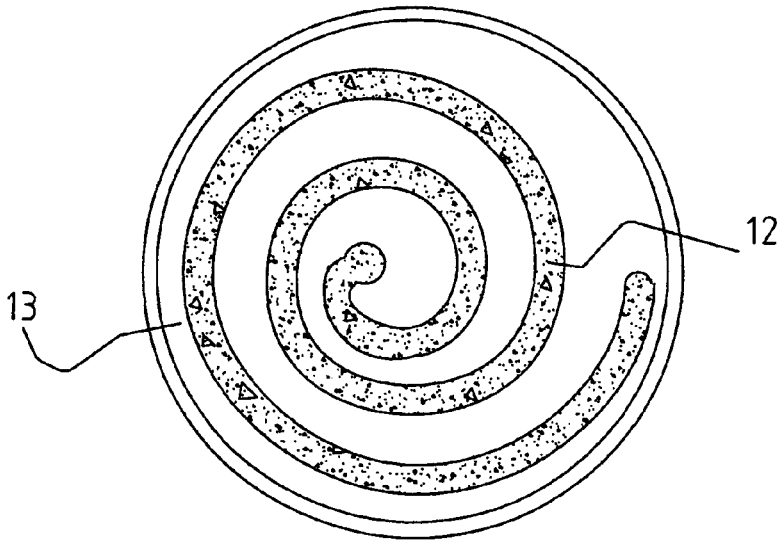
FIG. 3 is a plan view of the inventive polishing pad in accordance with still a further embodiment of the present invention.

In the embodiment shown in FIG. 3 the working layer is also interrupted and is formed as a spiral 12 composed of the body 1 and the abrasive powder 2 in the binder 3. Gaps 13 are formed between convolutions of the spiral 12, for example for improving supply of a cooling liquid and withdrawing of a material removed during polishing.

It will be understood that each of the elements described above, or two or more together, may also find a useful application in other types of constructions differing from the types described above.

While the invention has been illustrated and described as embodied in a polishing pad and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A polishing pad consisting of a working layer provided with an abrasive powder; an attaching layer for attaching a pad to a polishing head of a power tool; and a connection layer which connects said working layer with said attaching layer, said connection layer being located between said working and said attaching layers and having a central region which is thicker than a thinner peripheral region and therefore has an increased elasticity so that during polishing an elasticity of a central portion of said working layer is increased, said connection layer being configured as a one-piece layer, such that said central region of said connection layer and said peripheral region of said connection layer are of one piece with one another and composed of a same material, and also configured so that said central region of said connecting layer is formed as a less compressed region of the same material and said peripheral region of said connection layer is configured as a more compressed region of the same material.

2. A polishing pad as defined in claim 1, wherein said peripheral region of said connection layer is ring-shaped, while said central region of said connection layer is disc-shaped.

3. A polishing pad as defined in claim 1, wherein said working layer is an uninterrupted layer.

4. A polishing pad as defined in claim 1, wherein said working layer is an interrupted layer and includes a plurality of working elements.

5. A polishing pad as defined in claim 4, wherein said working elements are formed as separate working elements arranged adjacent to one another with spaces therebetween.

6. A polishing pad as defined in claim 4, wherein said working elements together form a continuous shape with gaps between portions of said continuous shape.

7. A polishing pad as defined in claim 1, wherein said working layer has a uniform thickness and is configured so as to follow an upper surface of said connection layer having said thicker central region and said thinner peripheral region.

* * * * *